US007195566B2

(12) United States Patent
Chang

(10) Patent No.: US 7,195,566 B2
(45) Date of Patent: Mar. 27, 2007

(54) GRIP OF SPORTS EQUIPMENT

(75) Inventor: Chun-Fu Chang, Taichung Hsien (TW)

(73) Assignee: Ming Hsing Leather Co., Ltd., Taichung Hsien (TW)

( * ) Notice: Subject to any disclaimer, the term of this patent is extended or adjusted under 35 U.S.C. 154(b) by 238 days.

(21) Appl. No.: 10/966,267

(22) Filed: Oct. 15, 2004

(65) Prior Publication Data

US 2006/0084519 A1 Apr. 20, 2006

(51) Int. Cl.
*A63B 53/14* (2006.01)

(52) U.S. Cl. ..... 473/300; 473/301; 473/302; 473/409

(58) Field of Classification Search ..... 16/421, 16/431, 436, 443, DIG. 18; 15/143.1; 74/543, 74/551.9; 81/557, 177.1, 177.3, 489; 473/300–303, 473/531, 549, 550, 551, 568
See application file for complete search history.

(56) References Cited

U.S. PATENT DOCUMENTS 6,551,198 B2 * 4/2003 Huang ..... 473/300
6,709,346 B1 * 3/2004 Wang ..... 473/300

* cited by examiner

*Primary Examiner*—William M. Pierce
(74) *Attorney, Agent, or Firm*—Charles E. Baxley

(57) ABSTRACT

The present invention discloses a grip of sports equipment comprising: an elastic sleeve having a first end and a second end, and the external diameter of the first end being larger than the external diameter of the second end; an annular extended skirt member being integrally extended to an edge of the second end of the elastic sleeve; a circular convex section being disposed around the external surface of the annular extended skirt member; and a circular concave section being disposed around the second end of the elastic sleeve; such that the annular extended skirt member is folded in the direction towards the second end and the circular convex section is embedded into the circular concave section when the annular extended skirt member is bound flatly on the second end. The invention improves the effect of binding the annular extended skirt member, so that the annular extended skirt member becomes a main structure for providing the binding force for the elastic sleeve and the wrapped end of a grip tape.

5 Claims, 3 Drawing Sheets

GRIP OF SPORTS EQUIPMENT

BACKGROUND OF THE INVENTION

1. Field of the Invention

The present invention relates to a grip of sports equipment, more particularly to a grip with a grip tape spirally wrapped around an elastic sleeve of the grip tape, and the elastic sleeve has an annular extended skirt member at its open end, and the annular extended skirt can be folded to tie the wrapped end of the grip tape.

2. Description of the Related Art

In general, the grip of traditional sports equipments has an elastic sleeve sheathed into a distal end of the grip of the sports equipment and a grip tape spirally wrapped around the elastic sleeve. The technique for wrapping the grip tape is to press the edge of the previous wrapped tape onto the edge of the later wrapped tape, and thus the wrapped end of the grip tape must be fixed by a fixture or else the grip tape will be loosened easily.

Please refer to FIGS. 2 and 3 of the pertinent prior-art U.S. Pat. No. 6,709,346 which comprises a sleeve and an annular skirt member being extended from an open end of the sleeve, and the extended skirt is folded backward to cover the exterior of the sleeve as to cover and fix the wrapped end of the grip tape. However, the Prior Art has a drawback of not having sufficient thickness at the opening of the sleeve, so that the sleeve does not have sufficient binding force on the sports equipment and thus the sleeve may have the problem of being slid or loosened.

Please refer also to FIGS. 5 to 8 of the prior art U.S. Pat. No. 6,709,346 which disclose a conical protruded ring at an open end of sleeve and an annular extended film extended from the open end of the conical protruded ring, and the annular extended skirt member further comprises a first section and a second section, and the external diameter of the first section is tapered outward and the increasing rate of the external diameter of the first section is approximately equal to the increasing rate of the external diameter of the protruded ring, and the length of the protruded ring is approximately equal to the length of the protruded ring. The second section is extended from an end of the first section with equal external diameters and then extended to a predetermined length. The extended skirt member can be folded backward, so the first section covers the protruded ring and the second section covers the wrapped end of the grip tape.

SUMMARY OF THE INVENTION

In view of the foregoing shortcomings of the prior arts, the present invention is intended to overcome the technical issue of the prior arts. Therefore, it is the primary objective of the present invention to provide a grip for sports equipment, which comprises a grip tape spirally wrapped around the exterior of an elastic sleeve and an annular extended skirt member integrally coupled to the open end of the elastic sleeve in order to improve the binding effect of annular extended skirt member, such that the annular extended skirt member becomes the main structure for providing a binding force to the open end of the elastic sleeve and the wrapped end of the grip tape.

The main technical characteristic of the invention comprises:

an elastic sleeve, having a first end and a second end, and the external diameter of the first end being larger than the external diameter of the second end;

an annular extended skirt member, being integrally extended to an edge of the second end of the elastic sleeve;

a circular convex section, being disposed around the external surface of the annular extended skirt member; and a circular concave section, being disposed around the second end of the elastic sleeve; such that the annular extended skirt member is folded in the direction towards the second end and the circular convex section is embedded into the circular concave section when the annular extended skirt member is bound flatly on the second end.

BRIEF DESCRIPTION OF THE DRAWINGS

The above objects, features and advantages of the present invention will become apparent from the following detailed description taken with the accompanying drawing. However, these drawings are provided for reference and illustration and not intended to act as a limitation to the present invention.

DETAILED DESCRIPTION OF THE PREFERRED EMBODIMENTS

Figure 1:
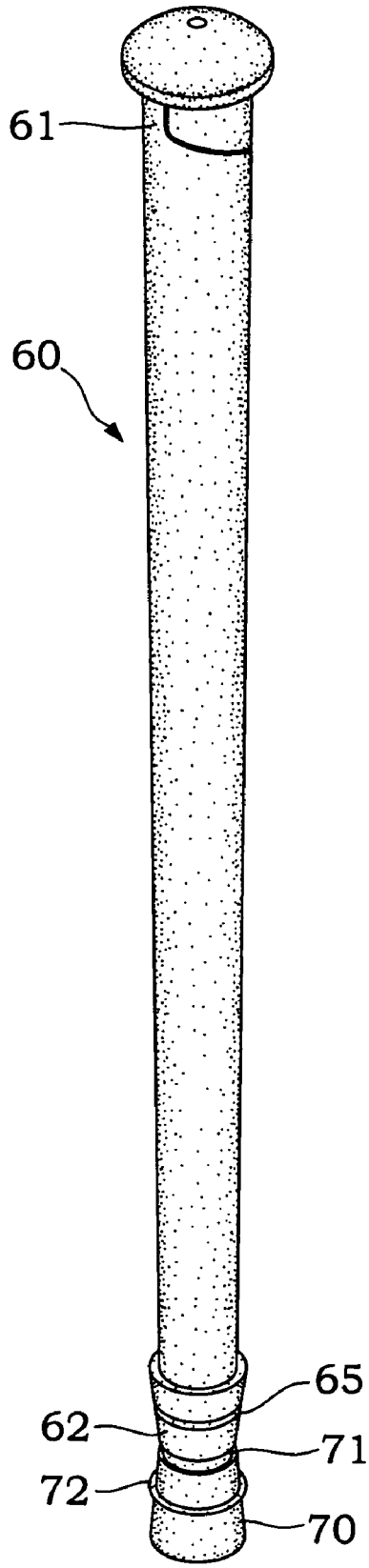
FIG. 1 is a perspective view of the elastic sleeve according to the present invention.

Please refer to FIG. 1 for the elastic sleeve 60 according to the present invention. The elastic sleeve 60 comprises a first end 61 and a second end 62, and the external diameter of the first end 61 is larger than the external diameter of the second end 62, such that the elastic sleeve 60 has a long conical profile, and the elastic sleeve 60 is hollow with equal diameters inside, and the first end 61 is an closed end while the second end 62 is an conical convex annular and the second end is an open end.

Figure 2:
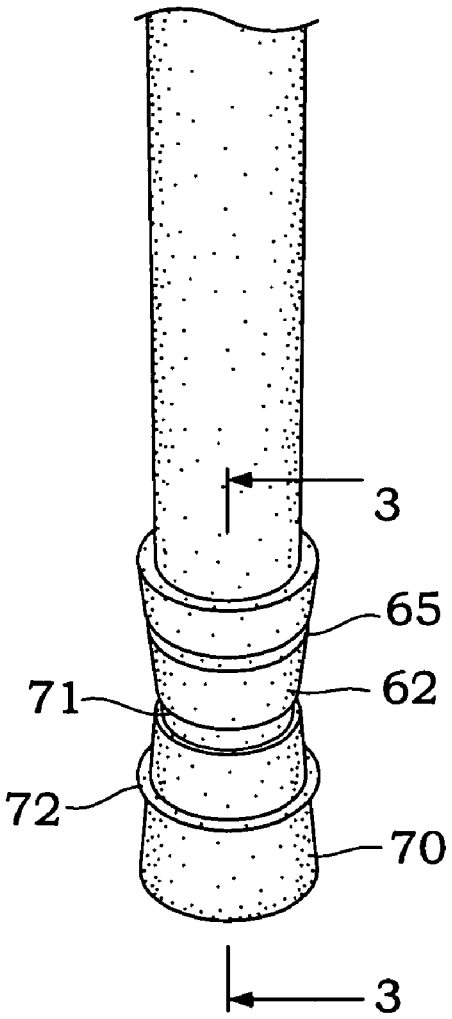
FIG. 2 is a perspective view of part of the elastic sleeve according to the present invention.
Figure 3:
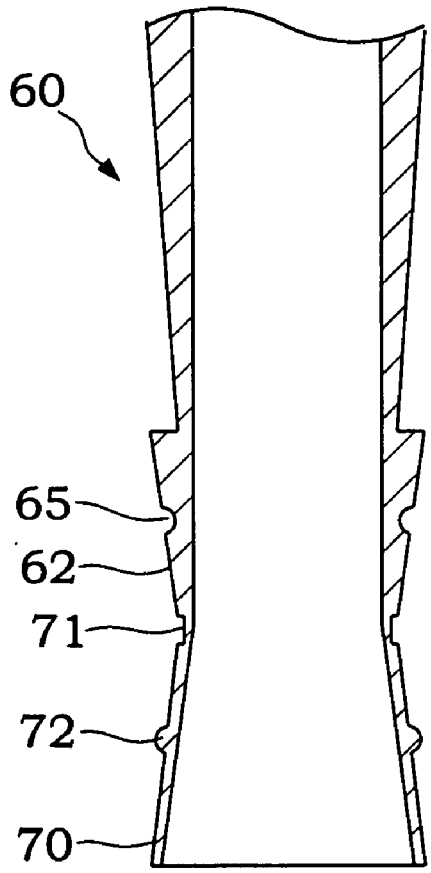
FIG. 3 is a cross-sectional view of section 3—3 as depicted in FIG. 2.

Please refer to FIGS. 1 to 3. The second end 62 of the elastic sleeve 60 has an annular extended skirt member 70 being integrally extended from the edge of the opening, and a concave boundary 71 is disposed at the connecting position of the annular extended skirt member 70 and the second end 62. The thickness of the annular extended skirt member 70 is thinner than the thickness of the cylindrical walls of the elastic sleeve, such that the sleeve 60 has better elasticity along the longitudinal and transversal directions. The internal and external diameters of the annular extended skirt member are tapered from the second end 62 of the elastic sleeve 60 and extended along the axial direction to a predetermined length, and the increasing rate of the diameter is approximately equal to the increasing rate of the external diameter of the second end 62 of the elastic sleeve 60. A circular convex section 72 is disposed at the surface area of the annular extended skirt member 70 is folded from the boundary 71 in the direction towards the second end 62, so that when the whole annular extended skirt member 70 is flatly attached and bound onto the second end 62, the circular convex section 72 is embedded into the circular concave section 65.

Figure 4:
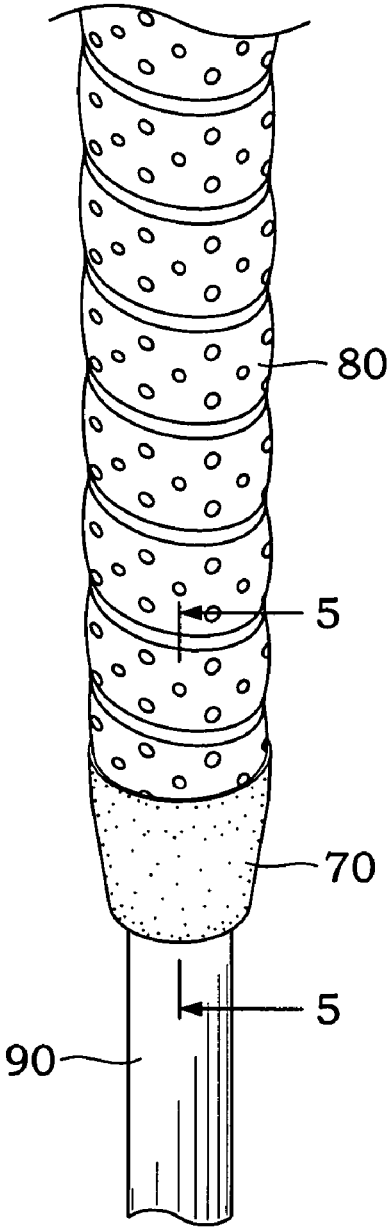
FIG. 4 is a perspective view of the annular extended skirt member of the elastic sleeve being folded and bound to an end of the grip tape according to the present invention.
Figure 5:
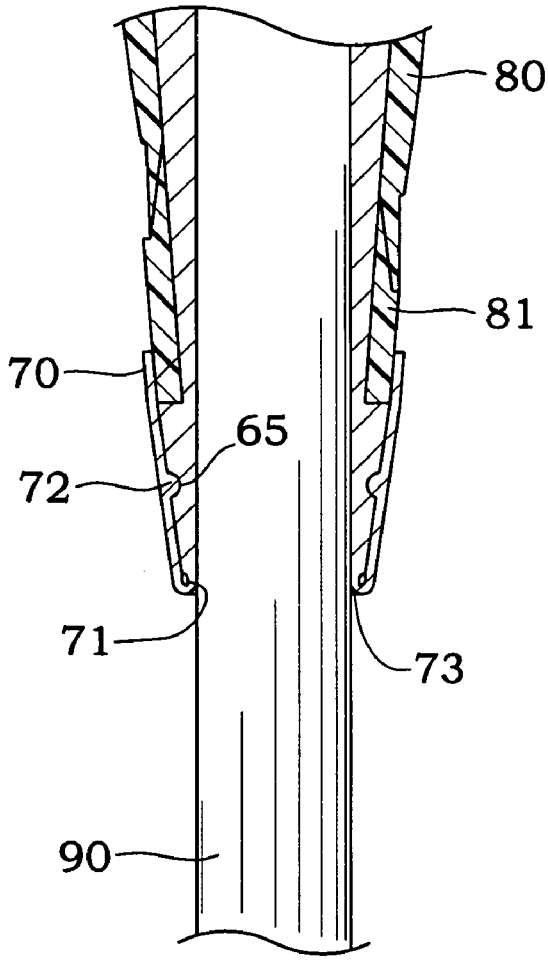
FIG. 5 is a cross-sectional view of Section 5—5 as depicted in FIG. 4.

Please refer to FIGS. 4 and 5. The grip tape 80 is wrapped spirally from the first end 61 to the second end 62 of the elastic sleeve 60 forming a wrapped end 81 at a position adjacent to the second end 62. The folded annular extended skirt member 70 can be bound to the wrapped end 81. The annular extended skirt member 70 makes use of its elasticity along the longitudinal and transversal directions to provide the overall binding force to the second end 62 and the wrapped end 81 of the grip tape 80 after the grip tape 80 is wrapped. Besides, the circular convex section 72 has the effect of improving the binding force on part of the annular extended skirt member 70 for working together with the thinner section of the second end 62 of the circular concave section 65. The circular convex section 72 is embedded into the circular concave section 65, such that the larger part of the binding force is applied on the grip rod 90 of the sports equipment through the thinner wall of the circular concave section 65 in order to improve the force for binding the second end 62 to the grip rod 90. Such arrangement can further enhance the stability of sheathing and fixing the elastic sleeve 60 onto the grip rod 90.

Please refer to FIGS. 4 and 5 for a further disclosure of the invention. After the annular extended skirt 70 is folded, a smooth folded edge 73 is formed at the connecting position with the second end 62. The folded edge 73 occurs at the foregoing circular concave boundary 71, and the circular concave boundary clearly separates the annular extended skirt member 70 and the second end 62 of the elastic sleeve 60.

While the invention has been described by way of examples and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A grip of sports equipment, comprising:

an elastic sleeve, having a first end and a second end, and the external diameter of said first end being larger than the external diameter of said second end;

an annular extended skirt member, being integrally extended to an edge of said second end of said elastic sleeve;

a circular convex section, being disposed around an external surface of said annular extended skirt member; and a circular concave section, being disposed around said second end of said elastic sleeve; such that said annular extended skirt member is folded in the direction towards said second end and said circular convex section is embedded into said circular concave section when said annular extended skirt member is bound flatly on said second end.

2. The grip of sports equipment of claim 1, wherein said annular extended skirt member is tapered along its internal and external diameter and extended from said second end to a predetermined length along its axial direction.

3. The grip of sports equipment of claim 2, wherein said annular extended skirt member has an axially increasing taper substantially equal to an axially increasing taper of the second end of the elastic sleeve.

4. The grip of sports equipment of claim 1 further comprising a boundary at the connecting position between said annular extended skirt member and said second end.

5. The grip of sports equipment of claim 1, wherein said annular extended skirt member has a thickness thinner than the cylindrical wall of said elastic sleeve.

* * * * *